US007841112B2

(12) United States Patent
Congdon

(10) Patent No.: US 7,841,112 B2
(45) Date of Patent: Nov. 30, 2010

(54) SOIL SLICING SPADE BIT AND MACHINE USING SAME

(75) Inventor: Thomas Congdon, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 116 days.

(21) Appl. No.: 11/897,041

(22) Filed: Aug. 29, 2007

(65) Prior Publication Data

US 2009/0056174 A1 Mar. 5, 2009

(51) Int. Cl.
*E02F 3/36* (2006.01)
*A01B 39/20* (2006.01)

(52) U.S. Cl. ..... 37/446; 37/411; 172/703

(58) Field of Classification Search ..... 37/411, 37/415, 416, 446, 449, 447, 448, 427, 435; 172/703
See application file for complete search history.

(56) References Cited

U.S. PATENT DOCUMENTS 231,148 A * 8/1880 Brykett ..... 37/446
872,439 A * 12/1907 Livengood ..... 37/446
1,503,866 A * 8/1924 Washburn et al. ..... 37/450
1,741,933 A * 12/1929 Gunnison ..... 172/701.3
1,803,654 A * 5/1931 Ronk ..... 414/726
1,976,303 A * 10/1934 Smitt ..... 172/701.3
2,154,503 A * 4/1939 French et al. ..... 37/413
2,184,045 A * 12/1939 Jeffrey ..... 37/446
2,243,831 A * 6/1941 Berner ..... 37/427
2,260,388 A * 10/1941 Le Bleu ..... 37/427
2,304,786 A * 12/1942 Armington et al. ..... 37/412
2,629,945 A * 2/1953 Przybylski ..... 37/446
2,729,001 A * 1/1956 Adams ..... 37/446
2,965,989 A * 12/1960 Hibbard ..... 172/701.2
2,981,015 A * 4/1961 Duke ..... 37/449
3,011,274 A * 12/1961 Richter ..... 37/449
3,021,626 A * 2/1962 Eyolfson ..... 37/446
3,042,123 A * 7/1962 Fry ..... 172/720
3,103,752 A * 9/1963 Rockwell ..... 37/446
3,136,077 A * 6/1964 Troeppl ..... 37/452
3,225,467 A * 12/1965 Troeppl ..... 37/452
3,345,765 A * 10/1967 Petersen ..... 37/449
3,349,508 A * 10/1967 Petersen ..... 37/457
3,398,472 A * 8/1968 Leijon ..... 37/444
3,497,973 A * 3/1970 Campbell ..... 37/446
3,653,133 A * 4/1972 Black et al. ..... 37/450
3,736,664 A 6/1973 Black et al.
3,851,413 A * 12/1974 Lukavich ..... 37/451
4,010,561 A 3/1977 Klett
4,077,142 A 3/1978 Klett et al.
4,108,250 A 8/1978 Merkel
4,110,921 A * 9/1978 Poker, Jr. ..... 37/446
4,123,861 A * 11/1978 Hemphill ..... 37/195
4,127,952 A * 12/1978 Chamberlain ..... 37/450
4,238,896 A * 12/1980 Lanz et al. ..... 37/450
4,343,101 A 8/1982 Klekamp et al.

(Continued)

*Primary Examiner*—Thomas A Beach
(74) *Attorney, Agent, or Firm*—Liell & McNeil

(57) ABSTRACT

Soil is captured into a bowl attached to a frame of a scraper machine by maneuvering the machine while a cutting bit attached to the bowl slices through the underlying soil. The bowl is supported on the frame, and the soil cutting is accomplished via a spade bit attached to the bowl at a cut opening. The spade bit has a cutting edge with a forward protrusion flanked by swept back segments. A top surface of the spade bit may be contoured with a central ridge flanked by a twist contour surface to urge soil towards opposite sides of the bowl.

11 Claims, 4 Drawing Sheets

U.S. PATENT DOCUMENTS 4,449,309 A * 5/1984 Hemphill ..... 37/444
4,704,812 A 11/1987 Paramore, Jr.
4,835,888 A * 6/1989 Hemphill ..... 37/457
4,969,279 A 11/1990 Mantingh
5,016,365 A * 5/1991 Robinson ..... 37/451
5,077,918 A * 1/1992 Garman ..... 37/452
5,172,499 A 12/1992 Griffin
5,212,897 A * 5/1993 Jefferson ..... 37/403
5,782,019 A * 7/1998 Launder et al. ..... 37/446
6,032,389 A 3/2000 Perry et al.
7,266,914 B2 * 9/2007 Grant ..... 37/446
2002/0194754 A1 12/2002 Brown
2003/0066214 A1 4/2003 Strong
2003/0066215 A1 * 4/2003 Grant ..... 37/446
2006/0230647 A1 10/2006 Cornelsen

* cited by examiner

SOIL SLICING SPADE BIT AND MACHINE USING SAME

TECHNICAL FIELD

The present disclosure relates generally to a cutting edge for a bowl of a scraper machine, and more particularly to a soil slicing spade bit.

BACKGROUND

One task often associated with earthwork construction projects relates to capturing soil at one location and depositing the soil at another location. The purpose of this soil movement is often to adjust elevations at different locations within a project area to some predetermined topography. Although this movement of soil can be accomplished in a variety of ways, one particular machine has demonstrated an ability to perform this earth moving task with particular efficiency. These machines are often referred to as scrapers, and typically come in the form of a machine that is pulled by a tractor, which may either be wheel or track type. While many scrapers are simply pulled by a tractor, some provide their own traction via a separate engine that applies rim pull to the wheels of the scraper. Thus, in some instances, the scraper is both pulled by a tractor and pushed through the soil via the wheels of the scraper, analogous to a four wheel drive vehicle. The scraper may also be pushed by a separate machine, such as by a track type tractor.

A typical scraper includes a bowl within which the soil is captured, and a cutting edge located adjacent a cut opening of the bowl. A depth of the cutting edge in the soil is typically set via an actuator that adjusts a pivot position of the bowl about an axle of the machine, but other strategies via raising and lowering the axle are also known. As the scraper is pulled forward, the cutting edge cuts through the soil with a cutting edge oriented perpendicular to the direction of travel, and guides the soil into the bowl. When the bowl is filled to some desired capacity, the bowl is pivoted up so that the cutting edge is out of contact with the soil, and the machine is transported to a deposit location where the soil is deposited. After depositing the soil, the scraper is typically returned to the soil capturing location to retrieve another load, and the duty cycle is repeated.

A typical cutting edge for a scraper is oriented perpendicular to a direction of travel of the machine, and typically extends across the width of the bowl. Some scrapers are also equipped with a so called stinger bit that provides a forward protrusion to the cutting edge across a central portion of a fraction of the bowl width. Such a structure is shown, for example, in U.S. Pat. No. 3,736,664. The stinger bit structure allows the operator to select from the full cutting width by engaging the entire cutting edge with the soil, or a reduced cutting width corresponding to the width of the stinger bit when the bowl is pivoted upward to decrease the engagement of the cutting edge with the underlying soil. As the bowl approaches its filled capacity with soil, an operator may pivot up the bowl to reduce the cutting edge to the width of the stinger bit to continue filling the bowl to its capacity before transporting the soil to a deposit location. This strategy is often utilized as it becomes increasingly difficult to urge more soil into a partially filled bowl as the capacity of the bowl is approached. Although a soil capture and transport strategy using a scraper in a duty cycle as previously described has performed well for many years, there remains room for improvement. In other words, there is constant pressure to improve efficiency by both reducing the energy required to fill a bowl to its desired capacity as well as reducing the time necessary for a single work cycle to capture, transport soil, deposit soil and return for another load.

The present disclosure is directed to one or more of the problems set forth above.

SUMMARY OF THE DISCLOSURE

In one aspect, a machine includes a bowl that defines a cut opening and is supported on a frame. A spade bit is attached to the bowl at the cut opening. The spade bit has a cutting edge with a forward protrusion flanked by swept back segments. A cut depth actuator is attached to the frame and is operable to change a cut depth of the spade bit.

In another aspect, a method of capturing soil in a bowl attached to a frame of a machine includes maneuvering the machine over soil. A position of a spade bit attached to the bowl is adjusted with respect to a soil level to engage the soil at a cut depth. The spade bit includes a forward protrusion flanked by swept back segments that slice through the soil.

In another aspect, a spade bit includes at least one metallic component having a configuration which a width dimension that is greater than a length dimension which is greater than a thickness dimension. The at least one metallic component defines a plurality of fastener bores distributed in a line along the width dimension in a pattern corresponding to a like pattern of fastener bores extending across a cut opening of a bowl of a scraper machine. The at least one metallic component includes a cutting edge extending the width dimension. The cutting edge has a spade shape with a forward protrusion flanked by swept back segments.

DETAILED DESCRIPTION

Figure 1:
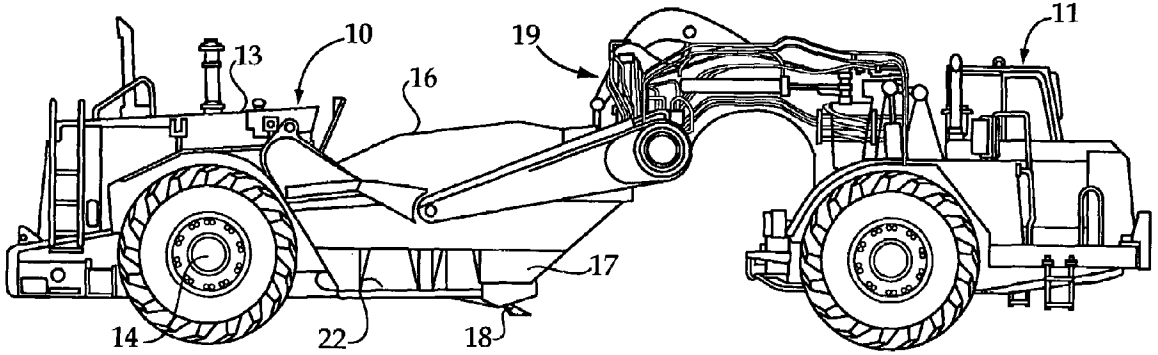
FIG. 1 is a side diagrammatic view of a machine and tractor according to one aspect of the present disclosure.
Figure 2:
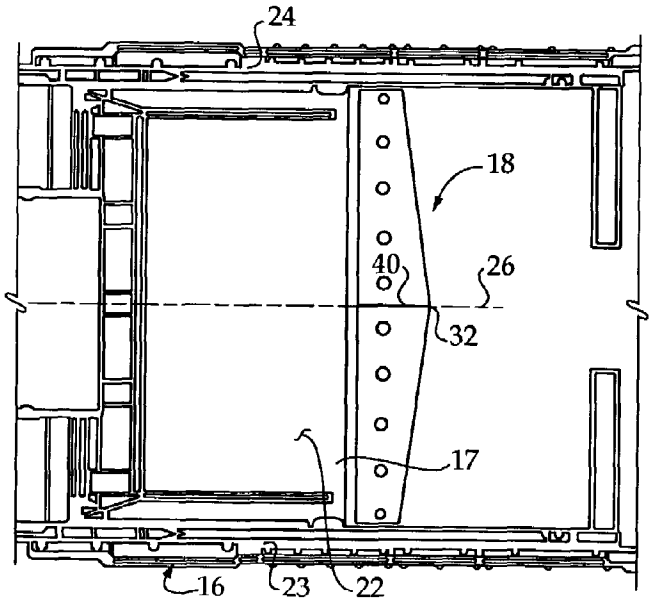
FIG. 2 is a top view of a bowl for the machine of FIG. 1.

Referring to FIGS. 1 and 2, a machine 10 is configured as a scraper and is pulled by a wheeled tractor 11. The machine 10 includes a frame 13 with an axle 14 about which a bowl 16 pivots via a cut depth actuator 19. Bowl 16 defines a cut opening 17 that allows soil to enter bowl 16 when machine 10 is maneuvered over soil. A spade bit 18 is attached to bowl 16 at cut opening 17. Although the present disclosure contemplates a spade bit 18 that may have its orientation adjusted with regard to bowl floor 22, the illustrated exemplary embodiment includes spade bit 18 attached, such as via conventional fasteners, at a fixed orientation with respect to bowl floor 22. This fixed orientation may be in the range of about 30 to 60 degrees, but any suitable attachment orientation falls within the contemplated scope of the present disclosure. FIG. 2 shows a top view of the bowl assembly 16 from the scraper machine 10 of FIG. 1. Bowl assembly 16 is of a typical construction in that it includes a relatively planar floor 22 flanked by first and second sides 23 and 24. The spade bit 18 may be attached to the bowl at cut opening 17 with a plurality of fasteners, such as plow bolts, in a conventional manner. Spade bit 18 includes a cutting edge 31 with forward protrusion 32 that is intersected by a centerline 26 of bowl 16. Forward protrusion 32 is flanked by swept back segments 33 and 34. In a typical manner, the cutting depth of machine 10 may be set at any of a continuum of different pivot positions via selective positioning of cut depth actuator 19 in a manner well known in the art.

Figure 3:
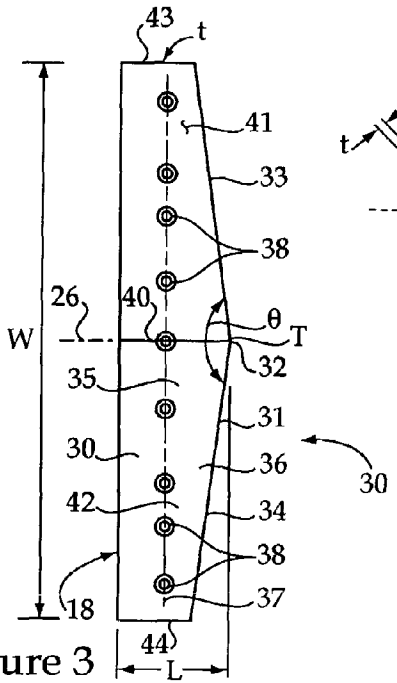
FIG. 3 is a top diagrammatic view of a spade bit according to the present disclosure.
Figure 4:
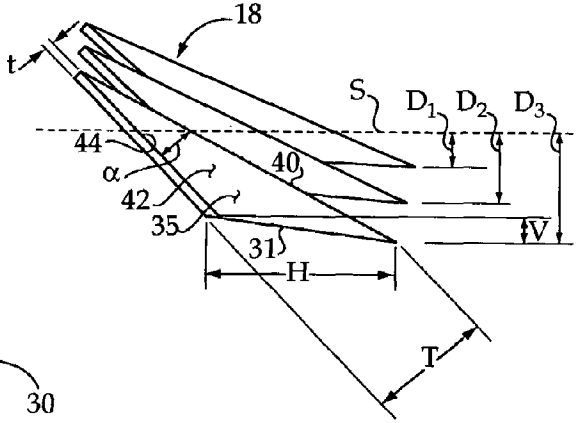
FIG. 4 is a side end diagrammatic view of the spade bit of FIG. 3 shown at three different cut depths.
Figure 8:
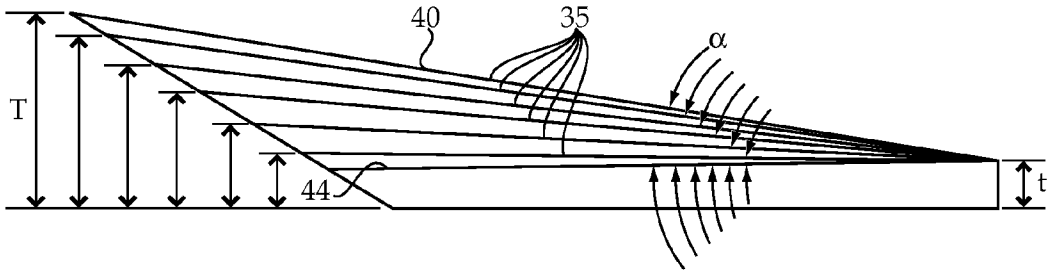
FIG. 8 is a side and diagrammatic view of the spade bit of FIGS. 3 and 7 with the top surface at each of the superimposed section views of FIG. 7 identified.
Figure 7:
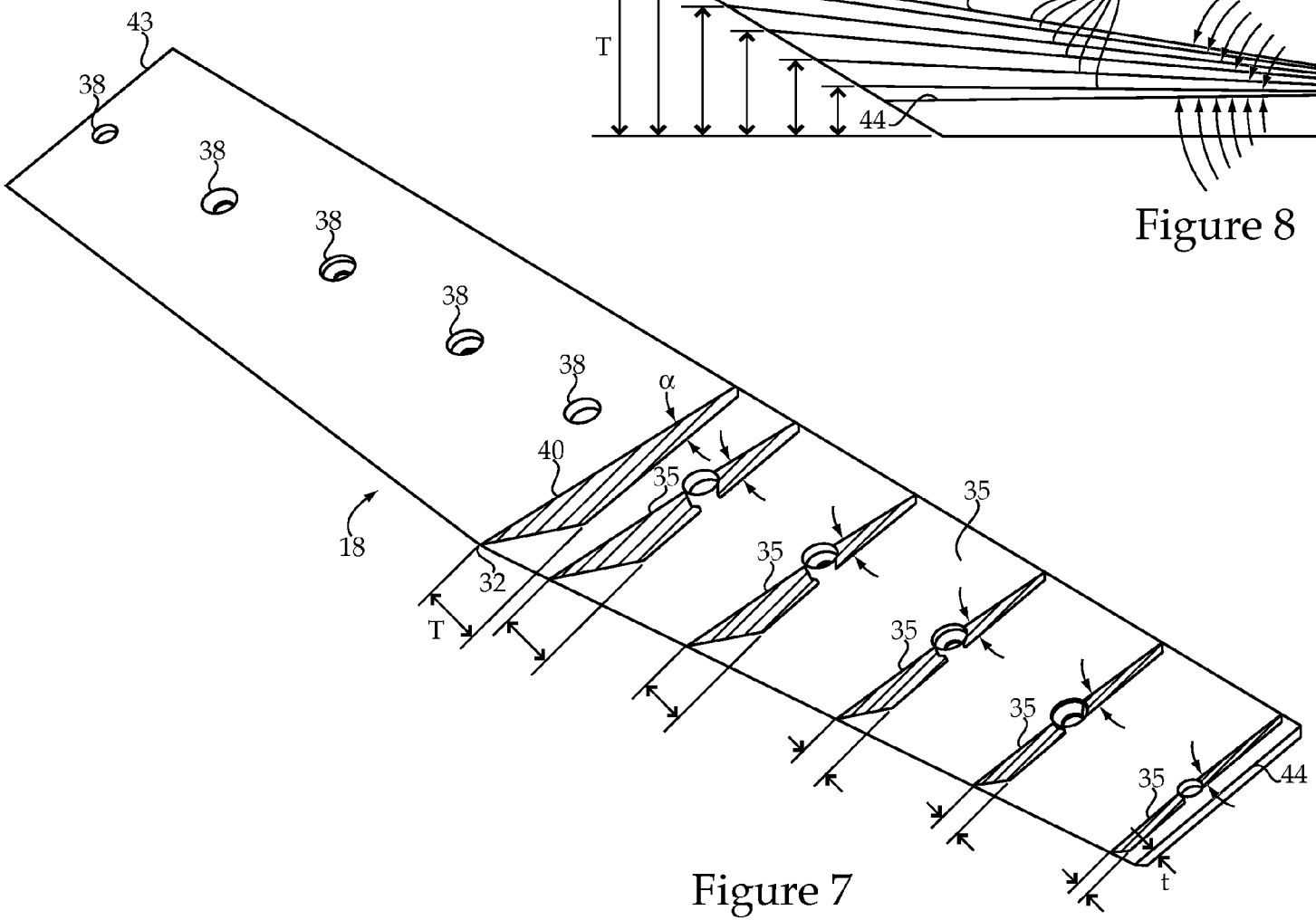
FIG. 7 is a perspective view of the spade bit of FIG. 3 with section views at different locations superimposed thereon.

Referring now in addition to FIGS. 3 and 4, a spade bit 18 is shown apart from bowl 16 as it may be provided as a spare or replacement part for attachment to any suitable scraper machine. In the illustrated embodiment, spade bit 18 comprises a single metallic component; however, those skilled in the art will appreciate that several separate segments that together comprise width dimension W fall within the contemplated slope of the present disclosure. This might be an attractive alternative so that each separate component might have a manageable weight for attachment and detachment to and from machine 10 without assistance by auxiliary lifting equipment. Spade bit 18 has a width dimension W that is greater than a length dimension L, which itself is greater than a maximum thickness dimension T. Although spade bit 18 may have a uniform thickness, the illustrated embodiment has a non-planar contoured surface 36 such that the maximum thickness T occurs in the region of forward protrusion 32 and then tapers downward in a sort of twist along top flanking surfaces 41 and 42 to lateral edges 43 and 44, respectively. The twist angle $\alpha$ of the top surface 35 is shown in FIG. 4 by the angle between central ridge 40 and the top lateral edge 44. The thickness taper and the decrease in the twist angle from the central ridge 40 is illustrated diagrammatically in FIGS. 7 and 8. Specifically, FIG. 7 shows several section views superimposed on spade bit 18 with the thickness tapering from a maximum T down to a minimum t at the lateral edges 43 and 44. In addition, FIG. 8 shows how the twist angle $\alpha$ is a maximum at central ridge 40 and decreases toward lateral edges 43 and 44 until finally becoming zero as the top lateral edge is parallel to the bottom lateral edge wherein the thickness becomes t, as also shown in FIG. 4. The same twist angle is reflected in the opposite direction from central ridge 40 toward top lateral edge 43, rendering the spade bit 18 symmetrical about the center line 26 of bowl 16, which is coincident with central ridge 40. This top surface contouring tends to urge soil toward opposite sides 23 and 24 of bowl 16 when spade bit 18 is slicing through the soil. Other surface contours, such as a planar faceted construction rather than a twist could also function to help urge soil toward the sides 23 and 24 of bowl 16. Nevertheless, a top surface 35 that is planar without any surface contours is also within the scope of the present disclosure. In other words, as soil moves over spade bit 18, the interaction with top flanking surfaces 41 and 42 urges the soil toward respective sides 23 and 24 of bowl 16. The top flanking surfaces 41 and 42 are bound on one side by cutting edge 31 and from each other by central ridge 40.

Referring back to cutting edge 31, the swept back segments 33 and 34 are oriented at an angle $\theta$ that is less than 180° but more than 160°. In the illustrated embodiment, swept back segments 33 and 34 each lie in a line. However, these swept back segments need not necessarily lie in a line, but a tangent to the swept back segments still should have an angle that is between about 160 and 180°. The term "about" means that when the number is rounded to two significant digits it corresponds to the disclosed angles. Thus, about 160 includes a range from 155 to 164. Although spade bit 18 may be attached to a bowl 16 in any suitable fashion, the illustrated embodiment shows a plurality of fastener bores 38 distributed in a line 37 in a pattern corresponding to a like pattern adjacent a cut opening 17 of a bowl 16 for a scraper machine 10. Nevertheless, other attachment strategies could be utilized including bolts, pins, welds or any other equivalent means known in the art.

Referring now specifically to FIG. 4, spade bit 18 is shown at three different cutting depths D1, D2 and D3 with regard to the soil surface level S. Because of the pivot action of bowl 16 at each of the different cutting depths D1-D3, spade bit 18 will present a different horizontal projection H and vertical projection V with regard to the reference line defined by soil surface level S. Inherent in the pivoting action of bowl 16 to change cutting depth D, the ratio of the horizontal H to vertical V projection will decrease with cutting depth D. However, testing suggests that the horizontal projection H is much more significant in improving performance than vertical projection V, and is always greater than vertical projection V at each of the cutting depths D1-D3 in the illustrated embodiment. Those skilled in the art will appreciate that other cut depth control strategies may allow the orientation of spade bit 18 to remain somewhat more fixed at each cutting depth without departing from the present disclosure. FIG. 4 also shows that the thickness T at central ridge 40 is substantially greater than the thickness t at lateral edges 43 and 44.

Those skilled in the art will appreciate that a spade bit according to the present disclosure can take on a wide variety of shapes without departing from the present disclosure. In all versions of the present disclosure, the forward protrusion 32 will present the forward most surface of the spade bit 18. It is believed that the forward protrusion acts to help promote failure in the soil ahead of cutting edge 31, causing reduction in cutting forces required for further penetration. In addition, the swept back orientation of swept back segments 33 and 34 results in a slicing action as the spade bit moves through the soil. The term slicing means that the cutting action has a transverse velocity component that is perpendicular to the cut direction. This is to be contrast with a non-slicing action of a conventional scraper blades that are oriented perpendicular to the direction of travel and hence have no slicing action as in a spade bit 18 according to the present disclosure. Although one particular shape of spade bit 18 has been illustrated, those skilled in the art will appreciate that other shapes would fall into the scope of the present disclosure provided that they included a forward protrusion with swept back segments. Although the illustrated embodiment shows linear swept back segments 33 and 34, other surface features could be present without departing from the intended scope of the present disclosure. In addition, the present disclosure also contemplates possibly substituting existing stinger bits for a new stinger spade bit that includes a forward protrusion and swept back segments as a possible way of first introducing the concepts of the present disclosure as a retrofit into currently available machines. Thus, a spade bit according to the present disclosure is something other than a cutting edge with multiple protrusions such as that shown for instance in U.S. Pat. No. 4,704,812 since it fails to include swept back segments.

INDUSTRIAL APPLICABILITY

The present disclosure finds potential application as a cutting edge for any machine, especially scraper machines, that cut through soil, especially for the purpose of moving soil from one location to another. Those skilled in the art will appreciate that scraper machines may have their own source of propulsion, but are often pulled by a wheeled or track type tractor, and may even be pushed by a separate machine, such as a track type tractor. The present disclosure finds application in new machines, as a replacement part for a machine, and also as a retrofit for existing machines to take advantage of the improved performance that may be afforded by the soil slicing spade bit 18 of the present disclosure.

In a typical duty cycle, an operator will maneuver machine 10 toward a location where soil is to be captured. As the machine 10 maneuvers over that location, the operator will pivot the bowl 16 so that the spade bit 18 engages soil at a cut depth D. If the operator initially goes too deep, the machine may lose traction and could possibly stall. Therefore, some skill is often necessary in initially engaging the soil to maintain forward motion of the machine during the initial soil capture portion of the duty cycle. In those cases the machine typically has its own engine for propulsion, such as the machine shown in FIG. 1 as essentially comprising a four wheel drive vehicle. A subtle but important phenomenon has been observed. This phenomenon relates to the fact that if the cutting edge 31 is engaged too deeply when the initial bowl filling operation is performed, the force on the cutting edge 31 and hence on the machine 10 itself can be directed in a direction that tends to lift axle 14 upward to reduce traction and hence create slippage. As the bowl begins to fill, the weight of the soil in the bowl 16 can overcome this phenomenon. Thus, over the initial bowl filling portion of the duty cycle, the combined downward force of soil in the bowl, which is low, combined with the drag force on the cutting edge 31 can result in an upward force on axle 14. In some instances, a less than skilled operator can engage so deeply at the initial cutting portion that the rear wheels that rotate around axle 14 can lose traction possibly causing the machine to slip or stall. A skilled operator can adjust the rate at which the cutting edge engages in soil in order to work through this segment of the duty cycle in the shortest amount of time while filling the bowl without undue traction slippage. In any event, the spade bit 18 of the present disclosure has been observed to decrease the duration of this phenomenon so that the machine can more quickly arrive at a force combination on axle 14 that results in a net downward force that enables a deeper engagement of the cutting edge 31, over the blunt edge stinger bit structures of the prior art. Furthermore, the top surface 35 of spade bit 18 may be contoured to urge the new soil toward the sides 23 and 24 of bowl 16 to further alleviate the effort necessary to push new soil into bowl 16.

During the middle segment of the cutting and soil capture procedure, the operator will typically operate the machine 10 so that it moves at a rate of about one to three miles per hour at maximum cutting depth D. As the soil capture procedure continues, it becomes increasingly difficult to push more soil into the bowl. As this occurs, the operator may adjust the pivot position of the bowl 16 so that the spade bit 18 presents a shallower cutting depth. Because of the swept back shape of spade bit 18, this may inherently result in different and smaller cutting width. This makes it easier for new soil to be pushed into the bowl 16. As the amount of captured soil begins to approach the capacity of bowl 16, the operator may then again readjust the pivot position of bowl 16 to further reduce the cutting depth (and consequently width) presented by spade bit 18. Furthermore, a shallower cutting depth tends to relax the side to side urging effect of the top surface contour to more easily allow soil to fill the center section of the bowl. At some point the desired amount of soil will have been captured and the operator will pivot the bowl 16 to a position where the cutting edge 31 of spade bit 18 no longer engages the underlying soil. At this point, the operator maneuvers the machine to a deposit location. The soil is ejected at the deposit location and then the operator returns to the capture location to begin another duty cycle in a similar manner.

Figure 5:
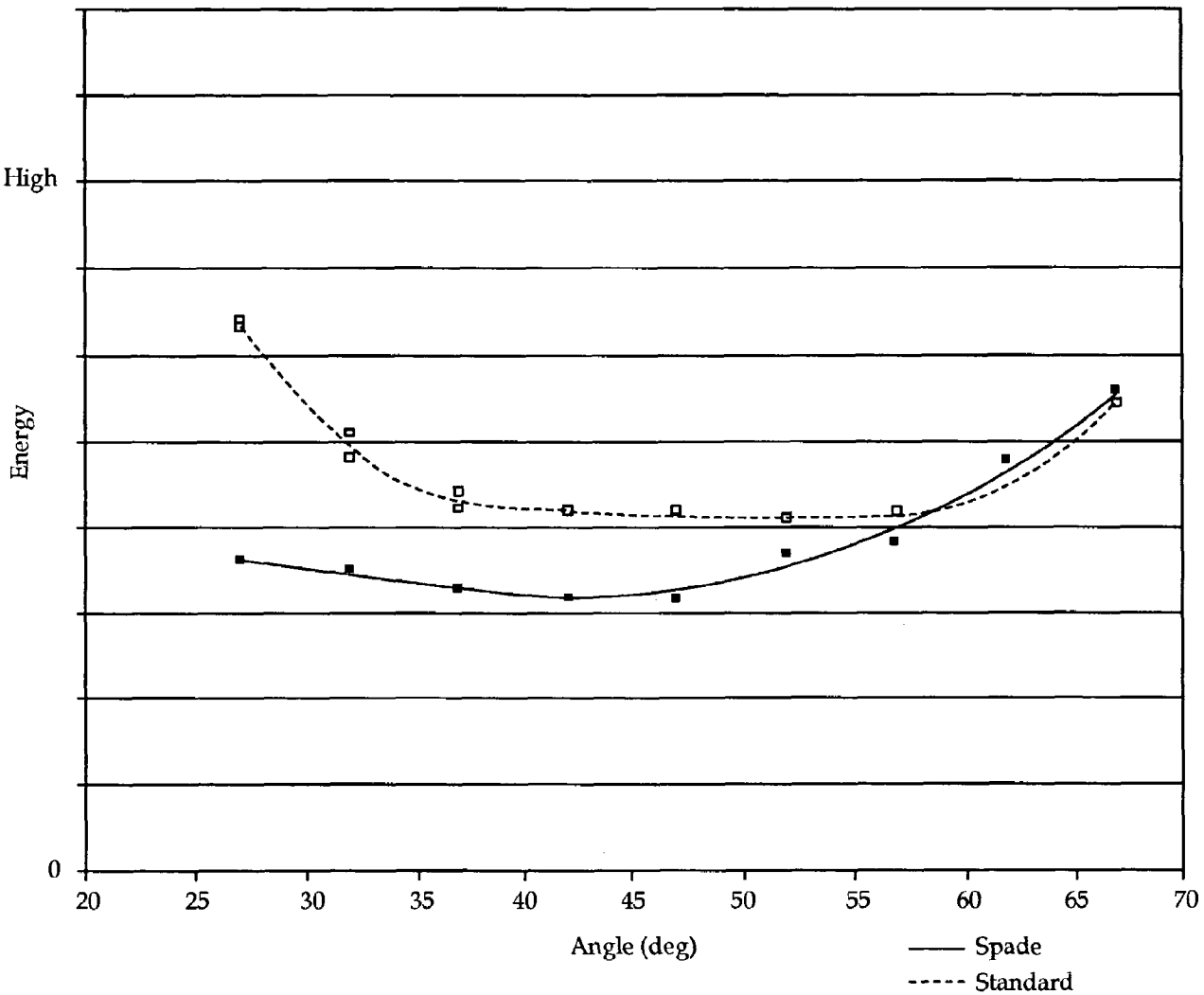
FIG. 5 is a graph of energy versus cutting edge soil engagement angle comparing the prior art to a machine according to the present disclosure.

Those skilled in the art will recognize that it requires substantial energy expenditures to move the cutting edge of the machine through soil by pushing pulling or otherwise moving the machine. The energy expenditure can typically be measured in quantities of fuel consumed by one or more internal combustion engines used to propel the machine over the soil retrieval site. FIG. 5 shows a comparison graph of the energy (fuel consumption) necessary to fill two identical scraper machine bowls, one using a soil slicing spade bit 18 according to the present disclosure, and the other a conventional cutting edge with a stinger bit according to the prior art. Two important insights emerge from this graph. First, the use of a spade bit allows an identical bowl to be filled with substantially less energy expenditure than an equivalent prior art machine utilizing a standard cutting edge with a stinger bit. Thus, an identical machine equipped with a spade bit according to the present disclosure may consume substantially less fuel to perform the same bowl filling operation of a prior art equivalent machine. The second insight that emerges from this graph relates to the energy consumption being relatively insensitive to the cutting edge angle relative to the horizontal over a relatively wide range of angles. This insight can be exploited to recognize that it may be desirable to attach the spade bit to the bowl at a fixed orientation. In other words, the ability to vary the angle of the cutting edge with respect to the bowl, such as that disclosed in co-owned patent application publication 2002/0194754, may not justify the additional complexity and expense for providing such an additional control feature. However, the present disclosure is intended to encompass machines with this enhanced capability, but one insight of this graph shows that the additional performance gain may not always justify the additional complexity and expense to provide such a feature. Although the data illustrated in the graph of FIG. 5 was gained through actual measurements with scaled models, the data is believed accurate when scaled to full sized machines.

Figure 6:
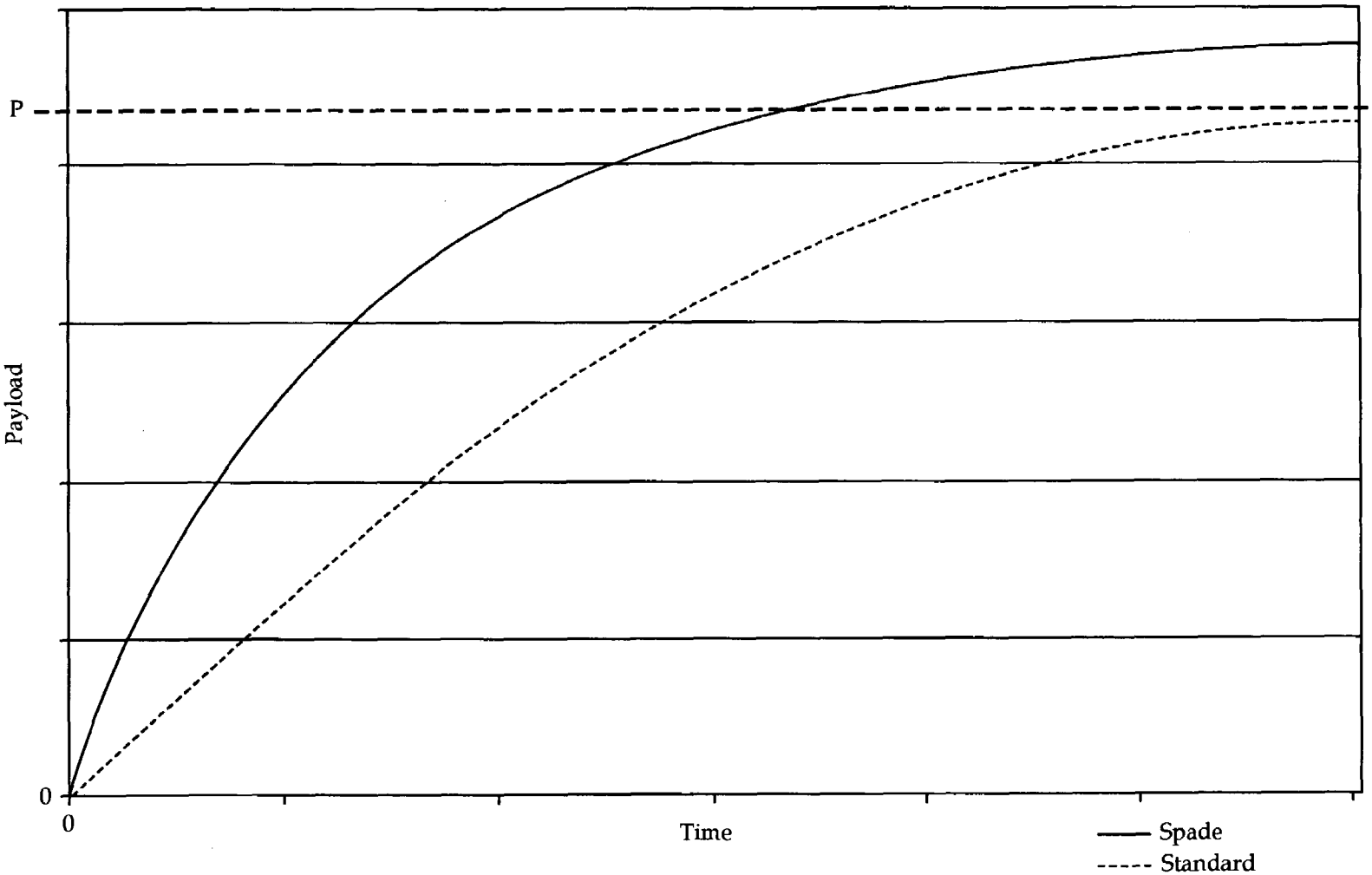
FIG. 6 is a graph of payload versus time comparing performance of a machine according to the present disclosure to the prior art.

Referring now to the graph of FIG. 6, it shows that the loading curve for a spade bit 18 according to the present disclosure is different from that of an equivalent prior art machine. The important insight to gather from this graph is that the prior art machine approaches its full payload rather asymptotically, but a machine equipped with a soil slicing spade bit according to the present disclosure arrives at full payload well before the curve starts flattening in an asymptotic way. This may allow for further increase for scrape bowl capacity. Thus, as illustrated, not only will a machine equipped with a spade bit according to the present disclosure consume less energy in filling a bowl, but may be able to do so in less time than that of a prior art machine. Thus, an equivalent machine with a spade bit 18 according to the present disclosure may perform more duty cycles in a given period of time than its counterpart equivalent prior art machine, and each of those duty cycles may consume less energy, which is usually measured in fuel consumption. Therefore, the spade bit 18 of the present disclosure may allow for both time and energy consumption improvements over an equivalent to prior art machine.

It should be understood that the above description is intended for illustrative purposes only, and is not intended to limit the scope of the present invention in any way. Thus, those skilled in the art will appreciate that other aspects of the invention can be obtained from a study of the drawings, the disclosure and the appended claims.

What is claimed is:

1. A machine comprising:

a frame;

a bowl supported on the frame and defining a cut opening;

a spade bit attached to the bowl at the cut opening, and the spade bit having a cutting edge;

a cut depth actuator attached to the frame and being operable to change a cut depth of the spade bit;

wherein the spade bit includes a top surface with a central ridge that terminates at the central protrusion, and a pair of top flanking surfaces bound by the cutting edge, the central ridge and a pair of lateral edges; and the cutting edge having the central protrusion flanked by swept back segments;

the spade bit having a maximum thickness at the central ridge that tapers downward toward the lateral edges, and a twist angle between the top surface and the lateral edge decreases in magnitude from the central ridge toward the lateral edges.

2. The machine of claim 1 wherein the top lateral edge is parallel to a bottom lateral edge.

3. The machine of claim 2 wherein the spade bit is symmetrical about the centerline of the cut opening.

4. The machine of claim 3 wherein the spade bit has a fixed orientation with respect to a floor of the bowl.

5. The machine of claim 4 wherein the swept back segments are oriented between 160 and 180 degrees apart.

6. The machine of claim 1 wherein the spade bit presents a horizontal projection that is greater than a vertical projection relative to a soil surface level at each cutting depth; and a ratio of horizontal projection to vertical projection decreases with increased cutting depth.

7. A method of capturing soil into a bowl attached to a frame of a machine, comprising the steps of:

maneuvering the machine over soil;

adjusting a position of a spade bit attached to the bowl with respect to a soil level to engage the soil at a cut depth; and slicing through the soil with swept back segments of the spade bit that flank opposite sides of a forward protrusion; and urging soil toward opposite sides of the bowl via a top surface contour of the spade bit that is defined by a thickness that tapers downward from a central ridge toward a pair of lateral edges and a twist angle between the top surface and the lateral edge decreases in magnitude from the central ridge toward the lateral edges.

8. The method of claim 7 wherein the maneuvering step includes pulling the machine with a tractor.

9. The method of claim 8 wherein the spade bit presents a horizontal projection greater than a vertical projection at each of a plurality of cut depths, and a ratio of the horizontal projection to the vertical projection decreases with increased cutting depth.

10. The method of claim 9 including fixing an orientation of the spade bit with respect to the bowl.

11. The method of claim 9 including a step of changing a cut depth by pivoting the bowl with respect to the frame.

* * * * *